US007665396B1

(12) United States Patent
Tippmann, Jr.

(10) Patent No.: US 7,665,396 B1
(45) Date of Patent: Feb. 23, 2010

(54) PROJECTILE LAUNCHER

(75) Inventor: Dennis J. Tippmann, Jr., Fort Wayne, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 317 days.

(21) Appl. No.: 11/633,200

(22) Filed: Dec. 4, 2006

(51) Int. Cl.
*F41A 1/04* (2006.01)
*B25C 1/08* (2006.01)
*F41B 11/00* (2006.01)

(52) U.S. Cl. ..... 89/7; 124/56; 124/74; 227/9

(58) Field of Classification Search ..... 89/7; 227/9, 10; 124/56, 74
See application file for complete search history.

(56) References Cited

U.S. PATENT DOCUMENTS

| | | | | |
|---|---|---|---|---|
| 645,932 | A | 3/1900 | Beck et al. | |
| 1,164,876 | A | 12/1915 | Sayler | |
| 1,166,837 | A | 1/1916 | Kelly | |
| 1,291,674 | A | 1/1919 | Brannon | |
| 1,375,653 | A | 4/1921 | McLain et al. | |
| 1,383,111 | A * | 6/1921 | Hall et al. | 89/7 |
| 2,665,421 | A * | 1/1954 | Temple | 227/9 |
| 2,947,221 | A * | 8/1960 | Griffin et al. | 89/7 |
| 3,202,055 | A | 8/1965 | Butler et al. | |
| 3,255,669 | A | 6/1966 | Olofsson | |
| 3,343,455 | A | 9/1967 | Lohr | |
| 3,346,984 | A | 10/1967 | Lohr | |
| 3,728,937 | A | 4/1973 | Nelson et al. | |
| 3,777,382 | A * | 12/1973 | Brunelle | 42/106 |
| 4,043,248 | A | 8/1977 | Bulman et al. | |
| 4,109,557 | A | 8/1978 | Zaucha | |
| 4,161,133 | A | 7/1979 | Black et al. | |
| 4,365,471 | A | 12/1982 | Adams | |

(Continued)

FOREIGN PATENT DOCUMENTS

| | | |
|---|---|---|
| JP | 60104806 | 6/1985 |

(Continued)

OTHER PUBLICATIONS

"Paintball Cannon"—Apr. 10, 2001; at http://www.geocities.com/pomanspaintball/cannon.html.

*Primary Examiner*—Bret Hayes
(74) *Attorney, Agent, or Firm*—Barnes & Thornburg LLP

(57) ABSTRACT

An apparatus for launching a projectile, such as a paintball. The apparatus includes a body defining a combustion chamber and a bore. A front bolt is provided that moves between a first position and a second position in which at least a portion of the front bolt is disposed within the combustion chamber in the first position. A rear bolt is movable between a third position and a fourth position such that at least a portion of the rear bolt is disposed within the combustion chamber in the fourth position. A drive mechanism is provided to urge the rear bolt to the fourth position. The apparatus includes an igniter device adapted to ignite a combustible mixture within the combustion chamber to propel the projectile through the bore. A portion of the rear bolt is configured to actuate the igniter device when the rear bolt moves to the fourth position. Typically, the igniter device includes a plunger and a portion of the rear bolt axially moves the plunger when the rear bolt moves from the third position to the fourth position.

18 Claims, 6 Drawing Sheets

U.S. PATENT DOCUMENTS 4,377,991 A 3/1983 Liesse
4,510,748 A 4/1985 Adams
4,616,622 A 10/1986 Milliman
4,665,868 A 5/1987 Adams
RE32,452 E 7/1987 Nikolich
4,712,379 A 12/1987 Adams
4,759,318 A 7/1988 Adams
4,821,683 A 4/1989 Veldman
4,838,142 A * 6/1989 Birk ..... 89/7
4,852,459 A 8/1989 Bulman
4,905,634 A 3/1990 Veldman
4,949,621 A 8/1990 Stephens
5,125,320 A 6/1992 Zielinski
5,140,892 A * 8/1992 Koine ..... 89/7
5,149,908 A * 9/1992 Schadow et al. ..... 89/7
5,199,626 A 4/1993 Terayama et al.
5,257,614 A 11/1993 Sullivan
5,333,594 A 8/1994 Robinson
5,361,700 A 11/1994 Carbone
5,377,628 A 1/1995 Adams
5,398,591 A * 3/1995 Gay ..... 89/33.03
5,462,042 A 10/1995 Greenwell
5,499,567 A * 3/1996 Gay ..... 89/7
5,511,333 A 4/1996 Farrell
5,540,194 A 7/1996 Adams
5,608,179 A * 3/1997 Voecks et al. ..... 89/7
5,613,483 A 3/1997 Lukas et al.
5,769,066 A 6/1998 Schneider
5,771,621 A 6/1998 Rogers
5,771,875 A 6/1998 Sullivan
5,845,629 A 12/1998 Ratliff
D410,182 S 5/1999 Etter et al.
5,967,133 A 10/1999 Gardner et al.
5,988,153 A 11/1999 Yoshimura
6,003,504 A 12/1999 Rice et al.
6,006,704 A 12/1999 Phillips et al.
6,016,945 A 1/2000 Phillips et al.
6,016,946 A 1/2000 Phillips et al.
6,019,072 A 2/2000 Phillips et al.
6,138,656 A 10/2000 Rice et al.
6,233,928 B1 5/2001 Scott
6,343,599 B1 2/2002 Perrone
6,371,099 B1 4/2002 Lee
6,418,920 B1 7/2002 Marr
6,474,326 B1 11/2002 Smith et al.
6,491,002 B1 12/2002 Adams
6,634,325 B1 10/2003 Adams
6,647,969 B1 11/2003 Adams
6,679,155 B1 * 1/2004 Yaschur et al. ..... 89/1.813
6,755,159 B1 6/2004 Adams et al.
7,254,914 B2 * 8/2007 Lund et al. ..... 42/106
2002/0088449 A1 7/2002 Perrone
2002/0108585 A1 8/2002 Davis
2002/0134069 A1 9/2002 Adams
2002/0134345 A1 9/2002 Adams
2002/0144498 A1 10/2002 Adams
2003/0005918 A1 1/2003 Jones
2003/0110758 A1 6/2003 Adams
2003/0131809 A1 7/2003 Adams
2004/0031382 A1 2/2004 Ogram
2004/0144012 A1 7/2004 Adams
2004/0144357 A1 7/2004 Adams
2006/0032487 A1 * 2/2006 Tippmann et al. ..... 124/74
2006/0266206 A1 * 11/2006 Lund et al. ..... 89/7
2007/0062363 A1 * 3/2007 Broersma ..... 89/7
2008/0190275 A1 * 8/2008 Tippmann ..... 89/7

FOREIGN PATENT DOCUMENTS

JP 4136696 5/1992
JP 5215492 8/1993
JP 6185894 7/1994

* cited by examiner

PROJECTILE LAUNCHER

TECHNICAL FIELD

The present invention relates to an apparatus for launching projectiles and particularly to an apparatus that uses fuel combustion to launch projectiles.

BACKGROUND

In many cases, compressed gas is used to launch projectiles. For example, paintball markers typically launch frangible projectiles, such as paintballs, by selectively releasing compressed gas. In addition to frangible projectiles, other non-lethal projectiles, such as BBs, pellets, air-soft pellets/BBs, darts, etc., are commonly launched using compressed gas, such as carbon dioxide and air.

Paintball markers are primarily used for paintball gaming. In paintball gaming, a player normally carries a paintball marker typically outfitted with a compressed gas tank and a hopper containing a supply of paintballs. It is not unusual for a player to carry an additional supply of paintballs for use, as well as extra compressed gas tanks. Currently, compressed gas tanks, such as carbon dioxide tanks, are limited to a relatively small number of shots. As paintball marker technology has developed, the firing rates of markers have increased, thereby requiring more compressed gas. Since tank size is limited, players are required to carry extras for a lengthy game session. Increasing substantially the number of shots-per-tank would reduce or eliminate the need to carry extra tanks. Such an increase would also reduce time spent on changing tanks in the field and/or on refilling tanks for subsequent use.

SUMMARY

According to one aspect, the invention provides an apparatus for launching projectiles using energy from the combustion of fuel. The apparatus may include a body defining a combustion chamber and a bore. A fuel injector may be provided that is movable between a dispensing position for dispensing a quantity of fuel into the combustion chamber and a fuel intake position for receiving a quantity of fuel from a fuel supply. The apparatus may include an igniter device, such as a piezoelectric device, to ignite a combustible mixture within the combustion chamber, which propels a projectile through the bore. An injection control mechanism may be provided that cycles the fuel injector between the dispensing and fuel intake positions responsive to ignition in the combustion chamber. In some cases, the injection control mechanism could pneumatically control the fuel injector. For example, the injection control mechanism could direct combustion gases from the combustion chamber into the fuel injector. In other embodiments, the injection control mechanism could mechanically control the fuel injector. For example, movement of a mechanical device, such as a bolt, could cycle the fuel injector.

In another embodiment, the fuel injector includes a piston that moves the fuel injector to the fuel intake position. For example, the fuel injector could have a cavity in fluid communication with the combustion chamber and the piston moves when a pressure within the cavity exceeds a predetermined pressure. In some cases, a primer actuator may be provided to manually move the piston.

In another embodiment, the fuel injector moves between a first position in which a fuel injection reservoir is in fluid communication with the combustion chamber and a second position in which the fuel injection reservoir is in fluid communication with a fuel supply. A biasing member may be provided to urge the fuel injector toward the first position. The apparatus may include a passageway for directing combustion gases from the combustion chamber into the fuel injector. Preferably, the fuel injector is configured to move to the second position responsive to the introduction of combustion gases from the combustion chamber into the fuel injector.

In a further embodiment, the apparatus includes means for controlling the fuel injector using pressurized gas. In some cases, the controlling means may use combustion gases from the combustion chamber to control the fuel injector.

In still a further embodiment, the apparatus includes a front bolt that moves between a first position and a second position. Typically, at least a portion of the front bolt is disposed within the combustion chamber in the first position. A rear bolt may be provided that moves between a third position and a fourth position. Preferably, at least a portion of the rear bolt is disposed within the combustion chamber in the fourth position. The apparatus may include a drive mechanism that urges the rear bolt to the fourth position. The rear bolt may include a projection that actuates the igniter device when the rear bolt moves to the fourth position.

In another embodiment, the apparatus may include a thermal barrier associated with the combustion chamber. The thermal barrier reduces heat escaping from the combustion chamber. Preferably, the thermal barrier includes a ceramic material. Typically, the ceramic material is applied to the interior surface of the combustion chamber. In some cases, the exterior surface of the combustion chamber may include a heat dissipating material that dissipates heat emanating from the combustion chamber.

According to another aspect, the invention provides a method for launching a projectile. The apparatus is moved to the cocked position, either due to automatic recocking or manual cocking. The user actuates the trigger assembly to release the rear bolt from the sear. The igniter device generates a spark due to movement of the rear bolt in a first direction. The fuel injector is pneumatically moved to a filling position. The combustion gas is released from the combustion chamber to propel the projectile due to movement of the rear bolt in a second direction. The fuel injector is moved to a dispensing position in which the combustion chamber is refilled with fuel.

Additional features and advantages of the invention will become apparent to those skilled in the art upon consideration of the following detailed description of the illustrated embodiment exemplifying the best mode of carrying out the invention as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the invention, and such exemplification is not to be construed as limiting the scope of the invention in any manner.

DETAILED DESCRIPTION OF THE DRAWINGS

Figure 1:
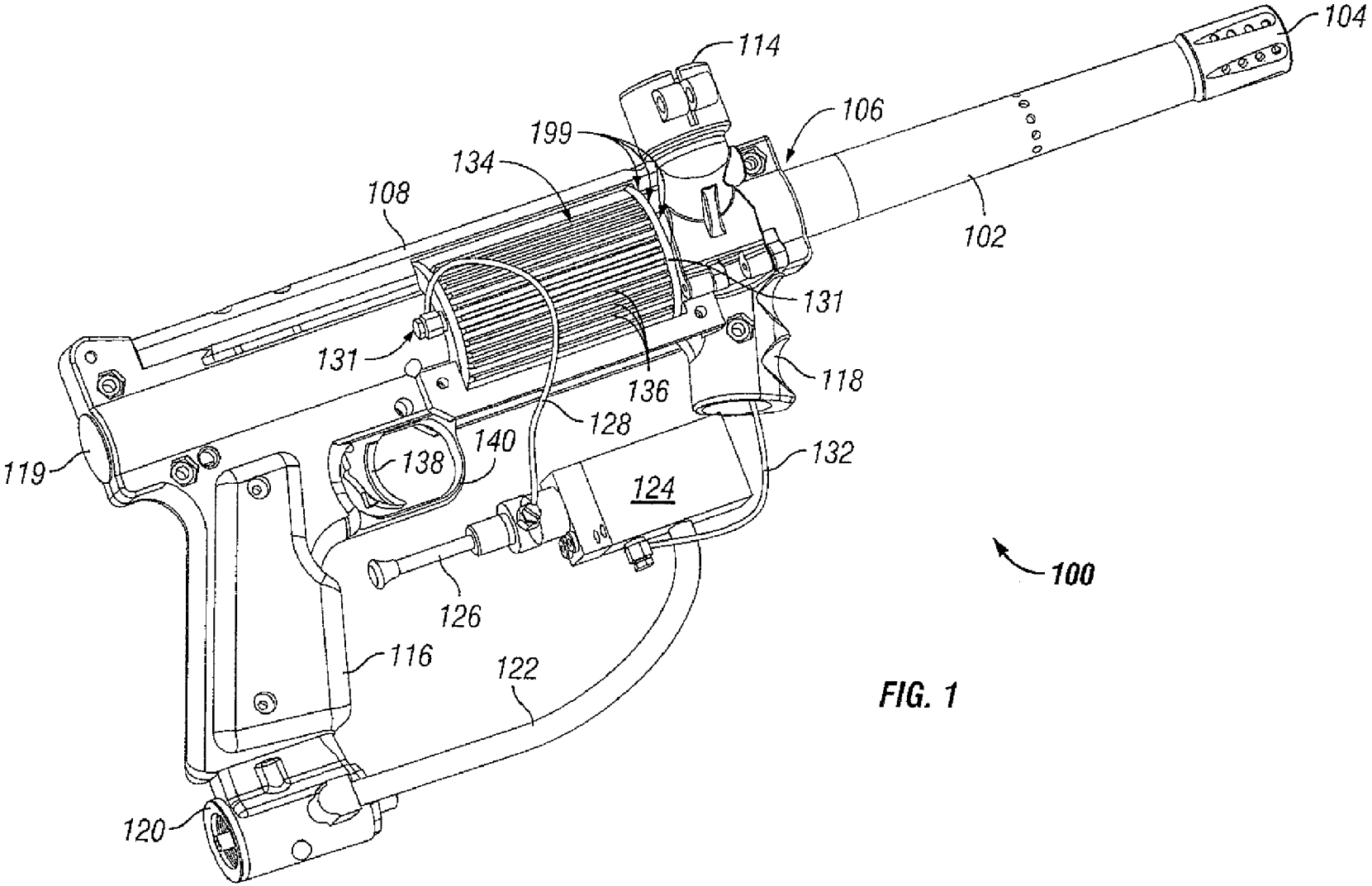
FIG. 1 is a right side perspective view of an example projectile launcher according to an embodiment of the present invention.

FIG. 1 shows a perspective view of an example apparatus 100 for firing projectiles. It should be appreciated that the apparatus 100 shown in FIG. 1 is provided for example purposes only. Although the example apparatus is described as a semi-automatic launcher, the apparatus 100 could have an automatic firing mechanism. If desired, the apparatus 100 could be easily modified to require manual cocking of the firing mechanism between each shot. The apparatus 100 may be used to launch a variety of projectiles. Typically, the apparatus 100 would be used to launch non-lethal projectiles that would be similar to those used in conjunction with compressed-gas guns, such as paint ball markers, air rifles, pellet rifles, nail guns, etc. By way of example only, the apparatus 100 may launch paintballs, BBs, pellets, air-soft pellets/BBs, darts, spark balls, pepper balls, nails, etc. In a particular application in which the apparatus 100 is a paintball marker, the apparatus 100 is sized to launch a frangible .68 caliber paintball at approximately 300 feet per second. By way of another example, the apparatus 100 may be a nail gun that is configured to propel nails into a surface.

In the example shown, the apparatus 100 includes a barrel 102 with a muzzle end 104 and a breech end 106. The breech end 106 of the barrel 102 may attach to a receiver 108, such as by screwing the breech end 106 into the receiver 108. By way of other examples, the barrel 102 may attach to the receiver 108 with an interference fit, frictional fit, or unitary formation. The barrel 102 includes a bore 110 dimensioned to receive a projectile 112 (See FIGS. 2-6). When the apparatus 100 is fired, the projectile 112 passes through the bore 110 in the barrel 102 and exits through the muzzle end 104.

In the embodiment shown, the projectiles 112 enter the receiver 108 using a projectile inlet port 114. A hopper (not shown) containing a plurality of projectiles may be received by the projectile inlet port 114 to feed projectiles into the receiver 108, for example. Embodiments are contemplated in which an integral magazine could be provided to feed projectiles into the receiver 108. It should be appreciated that other projectile feed mechanisms could be used.

In the example shown, the apparatus 100 includes a grip 116 that is dimensioned for a user to grasp. In some embodiments, the apparatus 100 may include an optional grip 118 that a user may grasp to steady the apparatus 100. In some cases, the apparatus 100 may be formed without a grip 116. For example, the apparatus 100 may be shaped similar to a rifle in which the user could hold the apparatus 100 via the receiver 108 and a rear stock (not shown). In some cases, the apparatus 100 may include a cavity adapted to receive a rear stock, for example. As shown, an end cap 119 covers the cavity.

In the example shown, the apparatus 100 includes a fuel supply receptacle 120 adapted to receive a supply of fuel. The fuel supply receptacle 120 may also be configured to regulate flow from the fuel supply. By way of example, the fuel supply may be stored at 80-100 psi, while the fuel supply receptacle 120 could limit flow to 40 psi. The term "fuel" is broadly intended to encompass any ignitable fluid, such as liquified petroleum ("LP") gas, natural gas, or gasoline. For purposes of example only, the fuel may include propane, butane, isobutene, methylacetylene-propadiene ("MAPP"), or acetylene. For example, a readily available propane canister could be used. In the example shown, the fuel supply receptacle 120 is formed near the bottom of the grip 116. It should be appreciated, however, that the fuel supply receptacle 120 may be located anywhere on the apparatus 100, so as to provide the apparatus 100 with a supply of fuel.

In some embodiments, a conduit 122 allows flow between the fuel supply receptacle 120 and a fuel injector 124. Although the fuel injector 124 is shown external to the receiver 108 in the example shown, embodiments are contemplated in which the fuel injector 124 may be internal to the receiver 108. It should be appreciated that an integral passageway in the receiver 108 could be used to provide fluid communication between the fuel supply receptacle 120 and the fuel injector 124. As shown, the fuel injector 124 is associated with a priming actuator 126 adapted to prime the apparatus 100 as described below.

In the example shown, an injection control line 128 directs flow of combustion gases from a combustion chamber 130 (FIGS. 2-6) into the fuel injector 124. A fuel injection line 132 directs fuel from the fuel injector 124 into the combustion chamber 130. In some embodiments, the injection control line 128 and/or the fuel injector line 132 may be internal passages defined in the receiver 108. By way of another example, the injection control line 128 and/or the fuel injection line 132 may be disposed within the receiver 108 if the fuel injector 124 is disposed inside the receiver 108.

In the embodiment shown, the apparatus 100 includes cooling fins 136 on the exterior wall 134 of the combustion chamber 130 to dissipate heat emanating from the combustion chamber 130. In the example shown, the exterior wall 134 of the combustion chamber 130 has an arcuate shape, which aids in heat dissipation by increasing the surface area of the combustion chamber 130.

In some cases, the exterior wall 134 could be coated with a heat dissipating material. One skilled in the art should appreciate that numerous suitable heat dissipating materials could be used. By way of example only, a portion of the exterior wall 134 may be coated with a product sold under the name Swain Black Heat Emitter by Swain Technology, Inc. of Scotsville, N.Y.

In some embodiments, a portion of the exterior wall 134 could be coated with a material having a low heat conductivity or other thermal barrier to prevent burns from user contact with possibly hot portions of the combustion chamber 130. It should be appreciated that numerous suitable low heat conductivity materials could be used, such as a ceramic coating or a product sold under the name Teflon™ by E. I. du Pont de Nemours and Company. For example, the tips of the cooling fins 136 could have a Teflon™ or ceramic coating.

In some cases, the exterior wall 134 could include both a heat dissipating portion and a heat retarding portion. For example, the tip of the cooling fins 136 could be ceramic coated, but the remainder of the exterior wall 134 could be coated with a heat dissipating material. In this manner, the receiver 108 would be "cool to the touch," but would also dissipate heat. In some cases, front and rear end caps 131 (FIG. 1) may be formed from (or coated with) a low heat conductivity material, such as Teflon™.

In some embodiments, an interior wall of the combustion chamber may be configured to prevent escape of heat from the combustion chamber 130. For example, the interior wall of the combustion chamber 130 may have a ceramic coating or other thermal barrier to reduce heat transfer to the walls of the combustion chamber 130. By way of example only, the interior wall may be coated with a product sold under the name Lukon Black. By way of another example, the interior wall may be coated or lined with a ceramic layer. By way of a further example, the interior wall may be coated or lined with Teflon™. In some cases, internal components that form the walls of the combustion chamber 130, such as a portion of the piston 162 (FIGS. 2-6), could be coated with a low heat conductivity material, such as a ceramic coating.

The apparatus 100 has a trigger assembly with a trigger 138 for actuation by the user to fire the apparatus 100. Preferably, the trigger assembly mechanically initiates firing of the apparatus 100 so that a battery or other electrical energy source is not needed. Embodiments are contemplated, however, in which the trigger assembly may include an electronic component that initiates firing. For example, the trigger 138 could be a push button switch, slide switch, etc. In the example shown, the trigger 138 is surrounded by a trigger guard 140.

Referring to FIGS. 2-6, in the example shown, the trigger 138 causes rotation of a sear 142 about a pivot pin 144. A biasing member 146 urges the sear 142 against a rear bolt 148. When the apparatus 100 is in the "cocked position," an engaging end 147 of the sear 142 engages a ledge 149 on the rear bolt 148, which prevents forward movement of the rear bolt 148. The "discharge position" refers to the position of the apparatus 100 when the projectile 112 is propelled out of the barrel 102. In the example shown, the discharge position is caused by the release of the rear bolt 148 by the sear 142 due to user actuation of the trigger 138.

The rear bolt 148 moves under the bias of a drive mechanism 150 in the example shown. For example, the drive mechanism 150 could be one or more springs adapted to urge the rear bolt 148 toward the breech end 106. In the example shown, the rear bolt 148 defines an internal cavity 151 dimensioned to receive the drive mechanism 150.

In the example shown, the rear bolt 148 drives a front bolt 152 against the bias of a return spring 154. In the example shown, the rear bolt 148 includes a projection 156 adapted to engage an igniter device 158 upon traveling a predetermined distance. In some example embodiments, the igniter device 158 may be a piezoelectric igniter. For example, the projection 156 may depress a plunger 160 adapted to generate a spark in the igniter device 158. It should be appreciated that other devices adapted to generate a spark, such as an electronic spark generator or coil powered by a battery, could be used.

As shown, the front bolt 152 is disposed in the combustion chamber 130 when the apparatus is in the cocked position. In the example shown, a piston 162 is disposed on a rear portion of the front bolt 152 while the front portion of the front bolt 152 has a projectile engaging end 164. In the example shown, the piston 164 includes passages 166 therethrough. A check valve 168 is adapted to prevent flow through the piston in the direction of arrow 170, but allows flow through the piston 162 in the direction of arrow 172. In the example shown, the piston 162 defines a cavity 163 dimensioned to receive a tip portion 165 of the rear bolt 148. In some cases, the tip portion 165 may include a seal to prevent combustion gases from flowing through the cavity 163 until the tip portion 165 exits the cavity 163. An exposed portion 167 extends from the tip portion 165. During combustion, the exposed portion 167 is subject to combustion forces, which urges the rear bolt 148 in a rearward direction as described below.

The fuel injector 124 selectively dispenses a quantity of fuel into the combustion chamber 130. In the example shown, the fuel injector 124 defines a cavity in which a fuel inlet valve 174 and a fuel injection valve 176 are slidably disposed. The fuel inlet valve 174 is configured to selectively block flow through a fuel inlet port 180, which is in fluid communication with a fuel supply through the conduit 122. The fuel injection valve 176 is adapted to block flow through a fuel injection outlet port 182, which is in fluid communication with a fuel injection inlet port 134 via the fuel injection line 132. In the embodiment shown, the valves 174, 176 are connected via link 178 so that the valves 174, 176 move in unison. In some embodiments, the valves 174, 176 and link 178 may be formed as an unitary member; embodiments are also contemplated in which the valves 174, 176 and link 178 are separate and are coupled together.

In the example shown, the valves 174, 176 are configured such that the fuel inlet valve 174 blocks the fuel inlet port 180 when the fuel injection valve 176 does not block the fuel injection outlet port 182; likewise, the fuel injection valve 176 blocks the fuel injection outlet port 182 when the fuel inlet valve 174 does not block the fuel inlet port 180.

As shown, the fuel injection valve 176 includes a stem 184 extending through a wall 186. An injection piston 192 is movable to engage the stem 184 thereby moving the valves 174, 176. In the example shown, the fuel injector 124 includes a sidewall 188 defining an injection control port 190 that is in fluid communication with the combustion chamber 130 via the injection control line 128. The injection control port 190 allows flow into a control chamber 191 defined in the fuel injector 124. Accordingly, when combustion occurs in the combustion chamber 130, combustion gases flow through the injection control line 128 into the control chamber 191. This causes the pressure within the control chamber 191 to increase sufficiently to move the injector piston 192 in the direction of arrow 170. This movement of the injector piston 192 moves the valves 174, 176. In the example shown, the injector piston 192 and the primer actuator 126 include seals 193 to prevent escape of combustion gases from the control chamber 191.

In other embodiments, the fuel injector 124 may be actuated mechanically, without the use of the injection control line 128. For example, the rear bolt 148 (or an extension of the rear bolt 148) may actuate the stem 184 to cycle the fuel injector 124. By way of another example, at least a portion of the fuel injector 124 may be disposed within the rear bolt 148. For example, the rear bolt 148 may have a cavity dimensioned to hold a quantity of fuel that is in fluid communication with the fuel injection line 132. A valve arrangement, similar to that of the fuel injector 124 shown in FIGS. 2-6, could be disposed within the rear bolt 148 and selectively dispense fuel into the combustion chamber 130.

As shown, a fuel injection reservoir 194 is disposed between the valves 174, 176. In the cocked position shown in FIG. 2, the fuel inlet valve 174 blocks flow of fuel into the fuel injection reservoir 194, while the fuel injection reservoir 194 is in fluid communication with the combustion chamber 130 via the fuel injection line 132 to direct flow into a fuel injection inlet port 134. A valve 198 allows flow from the fuel injection inlet port 134 into the combustion chamber 130, but prevents flow from the combustion chamber 130 into the fuel injection inlet port 134. A biasing member 202 is provided to urge the valves 174, 176 in the direction of arrow 172. In the example shown, the valves 174, 176 include seals 177 to prevent escape of fuel from the fuel injection reservoir 194. It should be appreciated that the fuel injector 124 could be configured to dispense fuel into the combustion chamber when the injection piston 192 engages the stem 184 and fill the fuel injection reservoir 194 when the injection piston 192 does not engage the stem 184.

An air intake port 199 is adapted to provide air flow into the combustion chamber 130 to create an air/fuel mixture. In the example shown, the valve 198 allows flow into the combustion chamber 130, but prevents flow from the combustion chamber 130 into the air intake port 199. Although the figures show a single air intake port, typically, a plurality of radially arranged air intake ports 199 may be disposed in the front end cap 131. For example, the valve 198 could be a flapper valve that controls fluid flow through the air intake ports.

Figure 2:
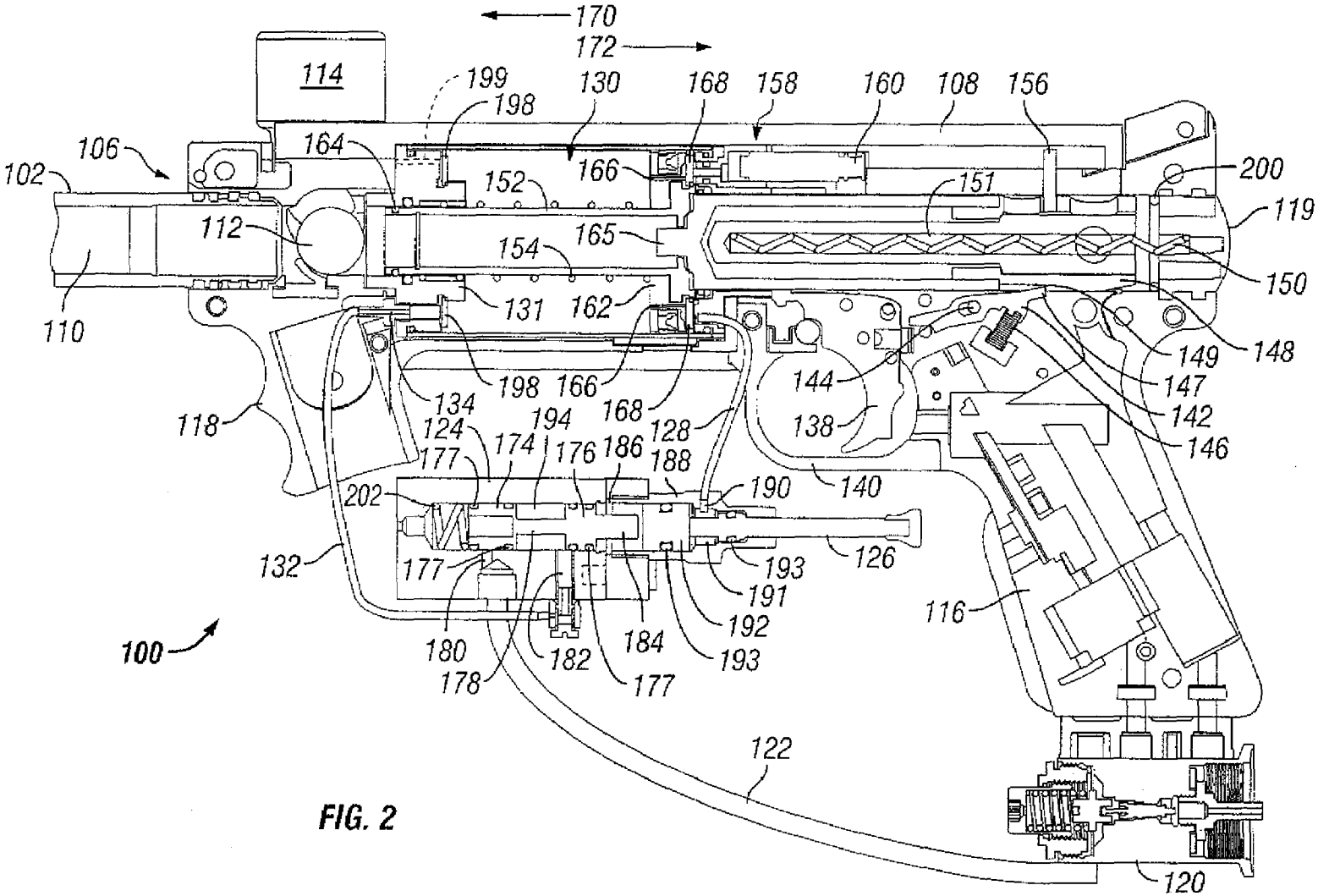
FIG. 2 is a left side cross-sectional view of the launcher shown in FIG. 1 in the cocked position.

The operation of the apparatus 100 will now be explained with reference to FIGS. 2-6. In FIG. 2, the apparatus 100 is in the cocked position. Accordingly, the sear 142 prevents forward movement (in the direction of arrow 170) of the rear bolt 148. The fuel injector 124 has the fuel inlet valve 174 blocking the supply of fuel into the fuel injection reservoir 194, while the fuel injection reservoir 194 is in fluid communication with the combustion chamber 130. If an air/fuel mixture is not present (or has dissipated) in the combustion chamber 130, the priming actuator 126 may be used to manually move the piston 192, thereby moving valves 174, 176 to supply fuel to the combustion chamber 130.

Figure 3:
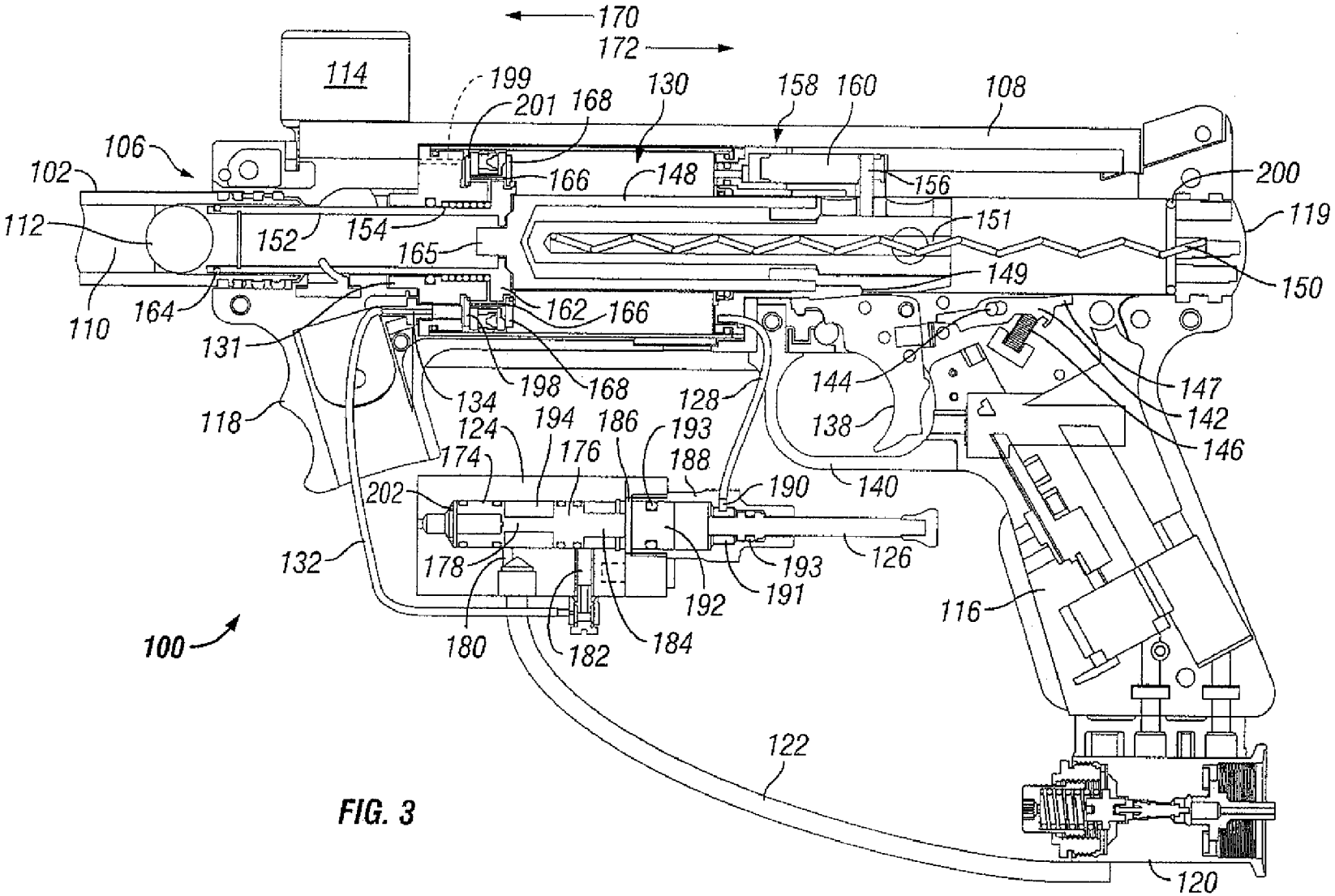
FIG. 3 is a left side cross-sectional view of the launcher shown in FIG. 1 after initial combustion of fuel.

FIG. 3 shows the apparatus 100 after actuation of the trigger 138. When the user actuates the trigger 138, the sear 142 releases the rear bolt 148, which causes movement of the rear bolt in the direction of arrow 170 due to the drive spring 150. The movement of the rear bolt 148 moves the piston 162 and front bolt 152 in the direction of arrow 170. This movement moves the projectile 112 into the breech end 106 of the barrel 102. As the piston 162 moves, the fuel/air mixture becomes turbulent due to the mixture flowing through the passages 166 in the piston 162. The rear bolt 148's continued movement causes the projection 156 to depress the plunger 160, thereby generating a spark in the combustion chamber 130. This causes the ignition of the air/fuel mixture within the combustion chamber 130.

In some cases, the apparatus 100 may include a safety mechanism adapted to move between a safe position in which the igniter device 158 is disabled and a fire position in which the igniter device 158 may generate a spark. By way of example, the rear bolt 148 may be associated with a cocking mechanism, which allows the apparatus 100 to be manually "decocked" while not in use. For example, the user could actuate the trigger 138 while using the cocking mechanism to control movement of the rear bolt 148. In some cases, for example when the igniter device 158 is a piezoelectric element with the plunger 160, the user could gently slide the rear bolt 148 forward against the plunger 160, without actuating the plunger 160. For example, a slot in the receiver 108 could limit movement of the rear bolt 148 to prevent actuation of the plunger 160. In this manner, actuating the trigger 138 would not fire the apparatus 100. When the user desires to use the apparatus 100 again, the cocking mechanism could be used to reset the rear bolt 148 with the sear 142 (i.e., recock the apparatus 100). In another embodiment, such as when the igniter device 158 is a spark generator, the safety mechanism may interrupt or ground a circuit to disable the spark generator. For example, the safety mechanism may be a switch in some cases.

As pressure builds within the combustion chamber 130, the fuel injection piston 192 moves in the direction of arrow 170 due to pressure exerted through the injection control line 128, which moves the valves 174, 176 in the direction of arrow 170. This movement of the valves 174, 176 provides fluid communication between the fuel injection reservoir 194 and the conduit 122, thereby filling the fuel injection reservoir 194 with fuel. The ignition within the combustion chamber 130 also closes the piston valve 168.

Figure 4:
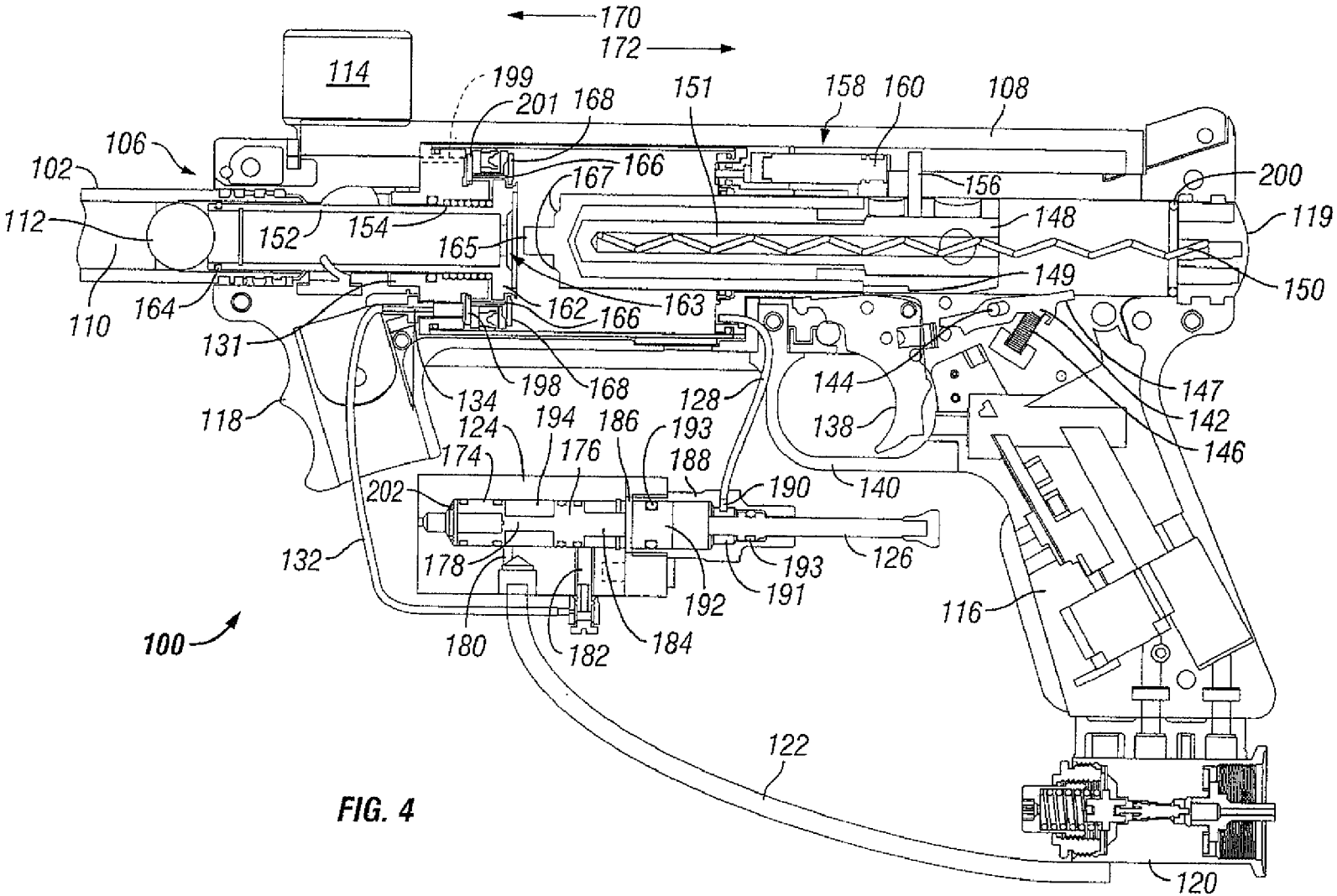
FIG. 4 is a left side cross-sectional view of the launcher shown in FIG. 1 showing initial rearward movement of the rear bolt after combustion.

Referring to FIG. 4, the pressure within the combustion chamber 130 applies a combustion force to the exposed portion 167 of the rear bolt 148, which causes the rear bolt 148 to move in the direction of arrow 172. The rearward movement of the rear bolt 148 removes the tip portion 165 from the cavity 163 in the piston 162. This allows combustion gases to flow through the front bolt 152, thereby propelling the projectile 112 out the barrel 102. The pressure on the injector piston 192 maintains the position of the valves 174, 176 due to combustion gases and pressure within the combustion chamber 130.

Figure 5:
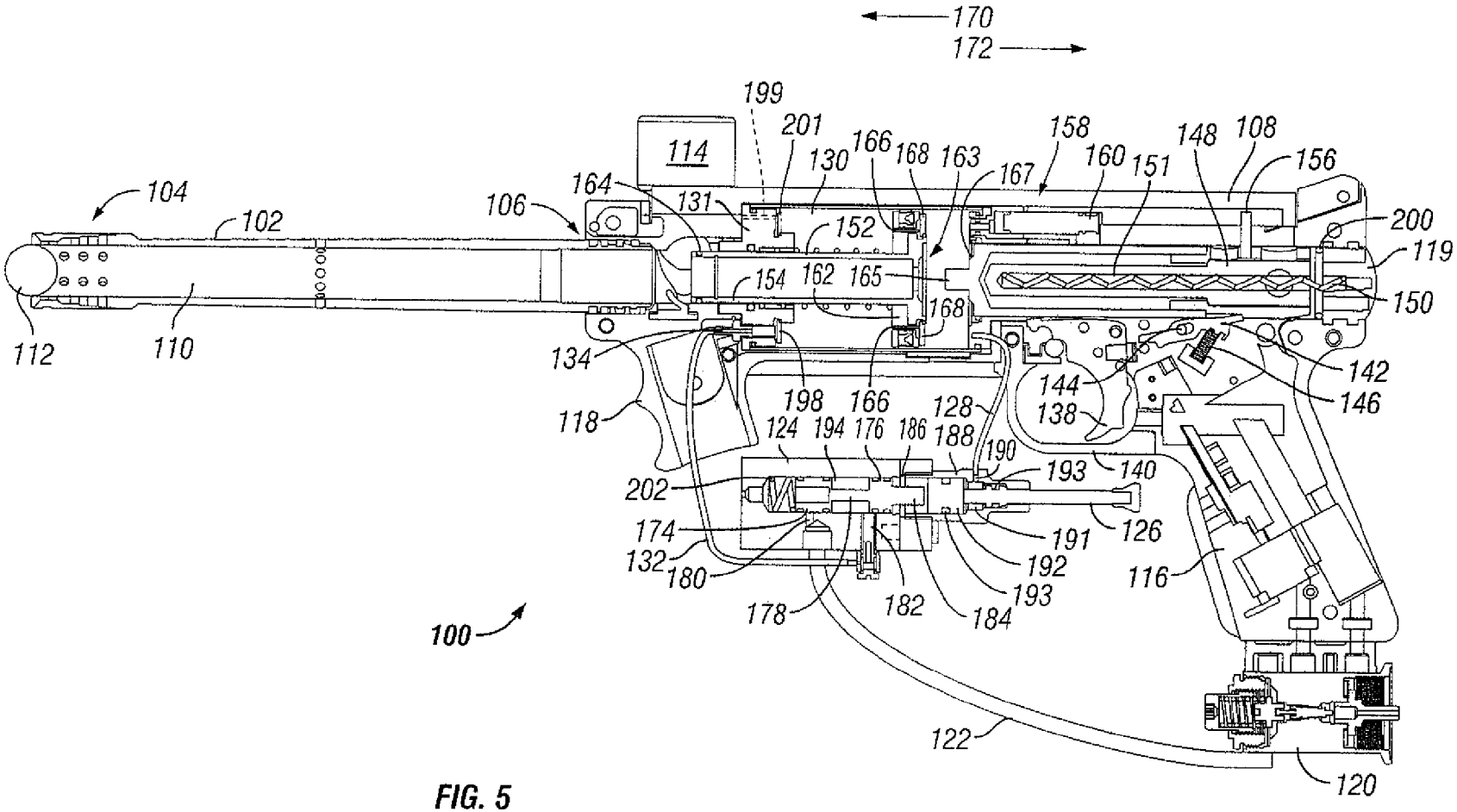
FIG. 5 is a left side cross-sectional view of the launcher shown in FIG. 1 in which combustion gases from the combustion chamber propel the projectile out the barrel.

Referring to FIG. 5, the rear bolt 148 continues movement in the direction of arrow 172 due to pressure within the combustion chamber 130 and impacts a rear cushion 200. The rear cushion 200 may be formed from a resilient material to absorb energy from the impact with the rear bolt 148, such as rubber. Although the rear bolt 148 rebounds off the cushion 200, due to the drive mechanism 150, the sear 142 prevents further forward movement of the rear bolt 148. As pressure within the combustion chamber 130 decreases, due to combustion gases exiting through the barrel 102, the front bolt 152 and piston 162 move in the direction of arrow 172 due to the urging of the return spring 154. Likewise, the valves 174, 176 move in the direction of arrow 172 due to the decrease in pressure from the combustion chamber 130 (and therefore decrease in pressure in the control chamber 191) and bias from a fuel injector spring 202, which allows fuel to flow from the fuel injection reservoir 194 into the combustion chamber 130. As the front bolt 148 and piston 162 move in the direction of arrow 172, air flows into the combustion chamber 130 through air intake port 199.

Figure 6:
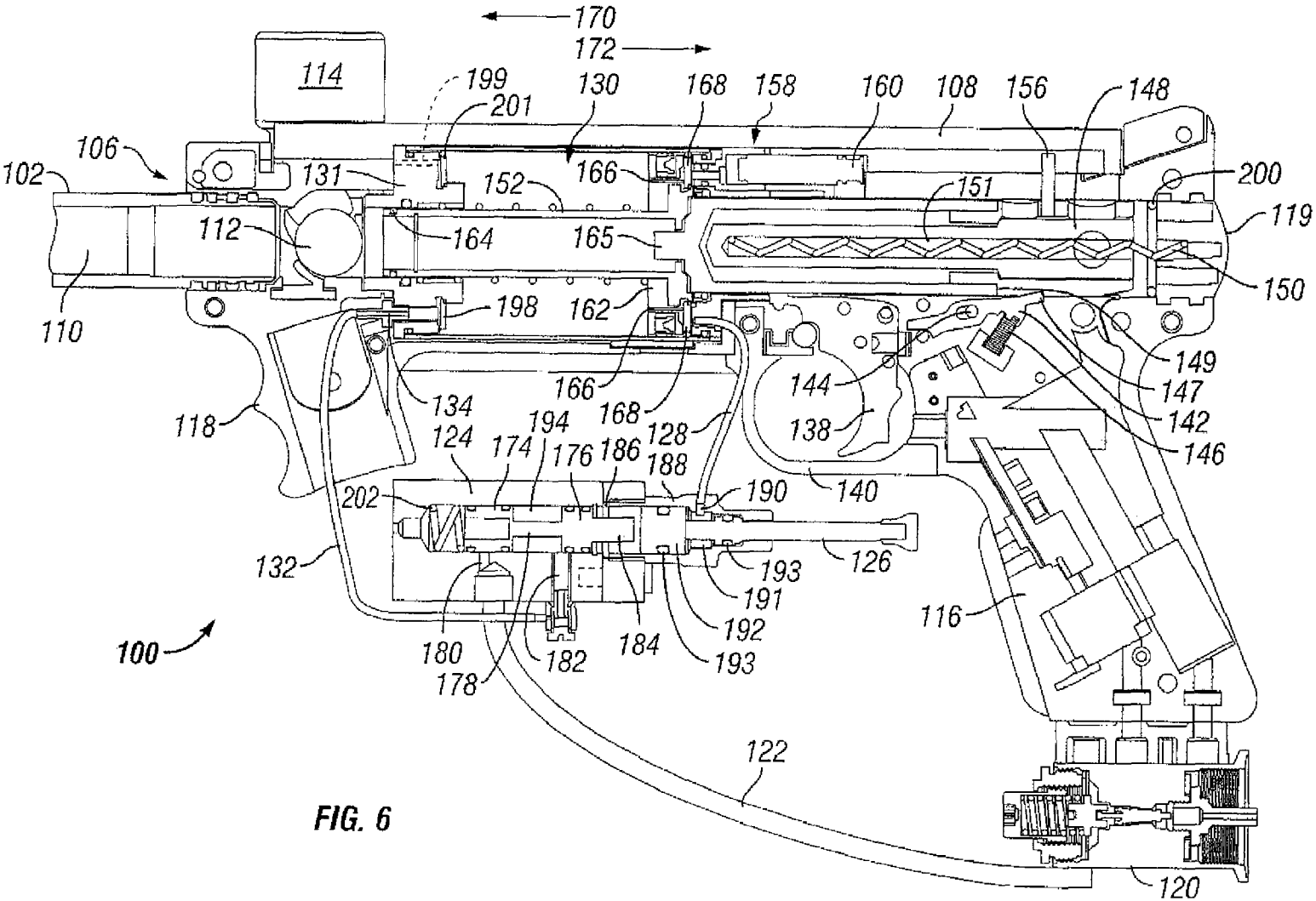
FIG. 6 is a left side cross-sectional view of the launcher shown in FIG. 1 in which a new projectile has entered the breech due to rearward movement of the front bolt.

Referring to FIG. 6, the return spring 154 has moved the front bolt 152 and piston 162 back to a cocked position, allowing a projectile 112 to enter into the breech. Accordingly, the combustion chamber 130 includes a fuel/air mixture that is ready for the next shot.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. An apparatus for launching projectiles comprising:

a body defining a combustion chamber and a bore;

a front bolt movable between a first position and a second position, wherein at least a portion of the front bolt is disposed within the combustion chamber in the first position;

a rear bolt movable between a third position and a fourth position, wherein at least a portion of the rear bolt is disposed within the combustion chamber in the fourth position;

a drive mechanism adapted to urge the rear bolt to the fourth position;

an igniter device adapted to ignite a combustible mixture within the combustion chamber to propel the projectile through the bore;

wherein a portion of the rear bolt is configured to actuate the igniter device when the rear bolt moves to the fourth position; and wherein the igniter device includes a plunger and wherein the portion of the rear bolt axially moves the plunger when the rear bolt moves from the third position to the fourth position.

2. The apparatus of claim 1, wherein at least a portion of the front bolt is disposed outside of the combustion chamber in the second position.

3. The apparatus of claim 2, wherein at least a portion of the rear bolt is disposed outside of the combustion chamber in the third position.

4. The apparatus of claim 1, wherein the igniter device is a piezoelectric igniter.

5. The apparatus of claim 1, wherein the plunger is disposed outside of the combustion chamber.

6. The apparatus of claim 5, wherein the portion of the rear bolt is disposed outside the combustion chamber when the rear bolt is in the fourth position.

7. The apparatus of claim 1, wherein the rear bolt includes a projection that extends laterally from the rear bolt to engage the igniter device when the rear bolt moves to the fourth position.

8. The apparatus of claim 1, further comprising a cushion, wherein the rear bolt impacts the cushion when moving to the fourth position.

9. The apparatus of claim 8, wherein the cushion is formed from a resilient material.

10. An apparatus for launching projectiles comprising:

a body defining a combustion chamber and a bore;

a front bolt movable between a first position and a second position, wherein at least a portion of the front bolt is disposed within the combustion chamber in the first position;

a rear bolt movable between a third position and a fourth position, wherein at least a portion of the rear bolt is disposed within the combustion chamber in the fourth position;

a drive mechanism adapted to urge the rear bolt to the fourth position;

an igniter device adapted to ignite a combustible mixture within the combustion chamber to propel the projectile through the bore;

a piston disposed between the front bolt and the rear bolt; and wherein a portion of the rear bolt is configured to actuate the igniter device when the rear bolt moves to the fourth position.

11. The apparatus of claim 10, wherein the piston defines at least one passageway therethrough, wherein the piston includes a valve configured to allow flow through the passageway when the piston moves in a first direction, but prevents flow through the passageway when the piston moves in a second direction.

12. The apparatus of claim 11, wherein the piston is integral with the front bolt.

13. The apparatus of claim 11, wherein the piston includes an opening dimensioned to receive a tip portion of the rear bolt.

14. The apparatus of claim 13, wherein the rear bolt includes an exposed portion extending from the tip portion that is disposed in the combustion chamber when the rear bolt moves to the fourth position, wherein combustion forces applied to the exposed portion urge the rear bolt toward the fourth position.

15. The apparatus of claim 10, farther comprising a biasing member adapted to urge the front bolt toward the first position.

16. The apparatus of claim 15, wherein the biasing member defines an opening that is dimensioned to receive at least a portion of the front bolt.

17. The apparatus of claim 16, wherein the rear bolt defines an internal cavity dimensioned to receive at least a portion of the drive mechanism.

18. The apparatus of claim 17, wherein the front bolt is operative to engage the projectile as the front bolt moves from the first position to the second position.

* * * * *